US008652014B2

(12) United States Patent
Smith

(10) Patent No.: US 8,652,014 B2
(45) Date of Patent: Feb. 18, 2014

(54) HEAVY TRAINING BAG

(75) Inventor: Jeff A. Smith, Colorado Springs, CO (US)

(73) Assignee: Ribcage Corp, Monument, CO (US)

( * ) Notice: Subject to any disclaimer, the term of this patent is extended or adjusted under 35 U.S.C. 154(b) by 322 days.

(21) Appl. No.: 13/156,173

(22) Filed: Jun. 8, 2011

(65) Prior Publication Data

US 2011/0237404 A1 Sep. 29, 2011

Related U.S. Application Data

(63) Continuation-in-part of application No. 12/571,278, filed on Sep. 30, 2009, now abandoned.

(51) Int. Cl.
*A63B 21/00* (2006.01)

(52) U.S. Cl.
USPC ..... 482/83; 482/87; 482/90

(58) Field of Classification Search
USPC ..... 482/83, 84, 85, 86, 87, 88, 90
See application file for complete search history.

(56) References Cited

U.S. PATENT DOCUMENTS

| | | | | |
|---|---|---|---|---|
| 1,708,638 | A | 4/1929 | Smith | |
| 2,197,545 | A | 4/1940 | Bachman et al. | |
| 3,033,151 | A | 5/1962 | Sheehan | |
| 3,756,592 | A * | 9/1973 | Johnson | 482/110 |
| 3,756,597 | A * | 9/1973 | Monti | 482/106 |
| 4,527,796 | A | 7/1985 | Critelli | |
| 5,147,258 | A | 9/1992 | Donohue | |
| 5,330,403 | A | 7/1994 | Kuo | |
| 6,099,441 | A * | 8/2000 | Bonnet | 482/93 |
| 6,106,443 | A | 8/2000 | Kuo | |
| 6,217,489 | B1 | 4/2001 | Nicholson | |
| 6,234,940 | B1 | 5/2001 | Fotsis | |
| 6,726,605 | B2 | 4/2004 | Chen | |
| 6,994,658 | B2 | 2/2006 | Laudenslager et al. | |
| 7,951,020 | B2 * | 5/2011 | Castor et al. | 473/458 |
| 2002/0028734 | A1 * | 3/2002 | Barber | 482/106 |
| 2002/0086776 | A1 | 7/2002 | Fields et al. | |
| 2002/0094917 | A1 | 7/2002 | Wang | |
| 2002/0198085 | A1 | 12/2002 | Wang | |
| 2004/0082445 | A1 * | 4/2004 | Zabel | 482/109 |
| 2006/0100067 | A1 | 5/2006 | Washburn et al. | |
| 2006/0166793 | A1 | 7/2006 | Gobel et al. | |
| 2007/0099772 | A1 | 5/2007 | Fu et al. | |
| 2008/0096733 | A1 | 4/2008 | Epstein | |
| 2008/0188360 | A1 | 8/2008 | Chu | |

OTHER PUBLICATIONS

Title Boxing, Gel Thai Heavy Bag, www.titleboxing.com, accessed Aug. 20, 2009, http://store.titleboxing.com/title-gel-thai-heavy-bag.html, Lenexa, KS, US.

* cited by examiner

*Primary Examiner* — Jerome W Donnelly
(74) *Attorney, Agent, or Firm* — BL Speer & Associates; Brenda L. Speer

(57) ABSTRACT

The present invention is a heavy training bag for pugilistic, martial and other similar arts, which provides uniform resistance and contains non-settling filler material. The bag comprises an optional support core contained within a cushion core, which in turn is contained within an impact core, which in turn is contained within an optional outer cover; further wherein the impact core is comprised of at least a rib, but preferably, a plurality of ribs.

10 Claims, 6 Drawing Sheets

HEAVY TRAINING BAG

CROSS-REFERENCE TO RELATED APPLICATION

This application claims the benefit of U.S. nonprovisional patent application Ser. No. 12/571,278 filed Sep. 30, 2009.

BACKGROUND OF THE INVENTION

1. Field of the Invention

The invention relates to exercise and fitness equipment, in particular a heavy training bag for pugilistic, martial and other similar arts, which provides uniform resistance and contains non-settling filler material.

2. Description of Related Art Including Information Disclosed Under 37 CFR 1.97 and 37 CFR 1.98

The typical prior art heavy training bag is comprised of an outer shell filled with a mixture of filler material, such as shredded cloth, foam or the like, and weight material, such as small sand pouches dispersed throughout the filler material. The filler material provides resistance and a cushioning effect to a user when the user strikes the prior art bag with any of his extremities (arms, legs, fists, hands, etc.); and the weight material provides weight to the heavy training bag to prevent erratic and exaggerated rebound after the prior art bag has been struck by a user.

Prior art heavy training bags have the disadvantage of having their contents settle over time and with use. The weight material sinks toward the bottom of the prior art bag. As a result, the prior art bags develop uneven resistance strike zones; wherein, the approximate top one-third of the prior art bag becomes a soft density and affords minimal resistance; the approximate middle one-third of the prior art bag becomes a medium density and affords average resistance; and the approximate bottom one-third of the prior art bag becomes a hard density and affords maximal resistance. As a further result, these variable strike zones reduce the area of the sweet spot of the prior art bag to the middle third of the bag, and the bottom third of the prior art bag poses the threat of physical injury to a user when striking the prior art bag due to the unyielding, hard density.

Various prior art bags have attempted to overcome these disadvantages and to reduce settling of the filler material and the resultant non-uniform resistance. Examples include changing the prior art bag filler material from the standard fill methodology of an aggregate filler, such as shredded cloth or rubber strips, interspersed with sand pouches, to a fluid, such as gas (typically atmospheric air), liquid (typically water) or a combination of gas and liquid. However, both fluids pose the problems of leakage from the prior art bag, non-uniform resistance and settling; in particular, a liquid-filled prior art bag does settle and the contents slosh upon impact resulting in erratic rebound.

Illustrative prior art that uses a fluid filler material of either gas, liquid, or a combination of gas and liquid are: U.S. Pat. No. 2,197,545 issued Apr. 15, 1940, by Bachman et al. for a Football Dummy; U.S. Pat. No. 4,527,796 issued Jul. 9, 1985, by Critelli for a Method of Filling an Athletic Bag with Air and Liquid; U.S. Pat. No. 5,147,258 issued Sep. 15, 1992, by Donohue for a Punching Bag Construction and Suspension; U.S. Pat. No. 5,330,403 issued Jul. 19, 1994, by Kuo for an Inflatable Punching Device; U.S. Pat. No. 6,106,443 issued Aug. 22, 2000, by Kuo for a Punching Bag; U.S. Pat. No. 6,726,605 issued Apr. 27, 2004, by Chen for a Punching Bag Having Solid Hanging Structure; US Patent Application Publication 2002/0086776 published Jul. 4, 2002, by Fields et al. for a Training Bag; US Patent Application Publication 2002/0094917 published Jul. 18, 2002, by Wang for a Punching Bag Assembly; US Patent Application Publication 2002/0198085 published Dec. 26, 2002, by Wang for a Punching Bag Assembly; US Patent Application Publication 2006/0166793 published Jul. 27, 2006, by Gobel et al. for an Assembly of Sports Equipment Fillable with Liquid and a Gelforming Means, and Sports Equipment for Use in this Assembly; US Patent Application Publication 2008/0096733 published Apr. 24, 2008, by Epstein for a Liquid-Fillable Heavy Training Bag; US Patent Application Publication 2002/0188360 published Aug. 7, 2008, by Chu for an Inflatable Cushion Bag for Striking; and a heavy training bag having an outside gel lining that is available from Title Boxing (www.titleboxing.com).

Other prior art bags have attempted to overcome the previously mentioned disadvantages and to reduce settling of the filler material and/or the resultant non-uniform resistance: (1) by use of various other filling materials, such as U.S. Pat. No. 1,708,638 issued Apr. 9, 1929, by Smith for a Tackling Dummy which discloses interior discs of a fibrous substance such as felt; U.S. Pat. No. 3,033,151 issued May 8, 1962, by Sheehan for a Ship and Pier Fender which discloses interior bags stuffed with nylon fiber waste; and U.S. Pat. No. 6,217,489 issued Apr. 17, 2001, by Nicholson for a Heavy Bag and Method for Filling which discloses use of shredded rubber as a filler material; (2) by a prior art bag that is rotatable about its horizontal axis by 180 degrees as needed in order to effect a substantially maintained consistency in resistance over its striking surface area as disclosed in US Patent Application Publication 2006/0100067 published May 11, 2006, by Washburn et al. for a Training Bag; (3) by means of a multi-compartmented prior art bag that provides for resistance which can be varied as desired by a user such as: U.S. Pat. No. 6,994,658 issued Feb. 7, 2006, by Laudenslager et al. for a Modular Heavy Bag; and US Patent Application Publication 2007/0099772 published May 3, 2007, by Fu et al. for an Adjustable Punching; and (4) by means of a prior art bag that provides for an outer core of impact material to protect a user from the settling effects of an inner core of filler material as disclosed in U.S. Pat. No. 6,234,940 issued May 22, 2001, by Fotsis for a Training Bag.

BRIEF SUMMARY OF THE INVENTION

The present invention is a training bag for pugilistic, martial and other similar arts, which provides uniform resistance and contains non-settling filler material. The bag comprises an optional support core contained within a cushion core, which in turn is contained within an impact core, which in turn is contained within an optional outer cover; further wherein the impact core is comprised of at least a rib, but preferably, a plurality of ribs.

BRIEF DESCRIPTION OF THE SEVERAL VIEWS OF THE DRAWING(S)

LIST OF REFERENCE NUMERALS

Figure 1:
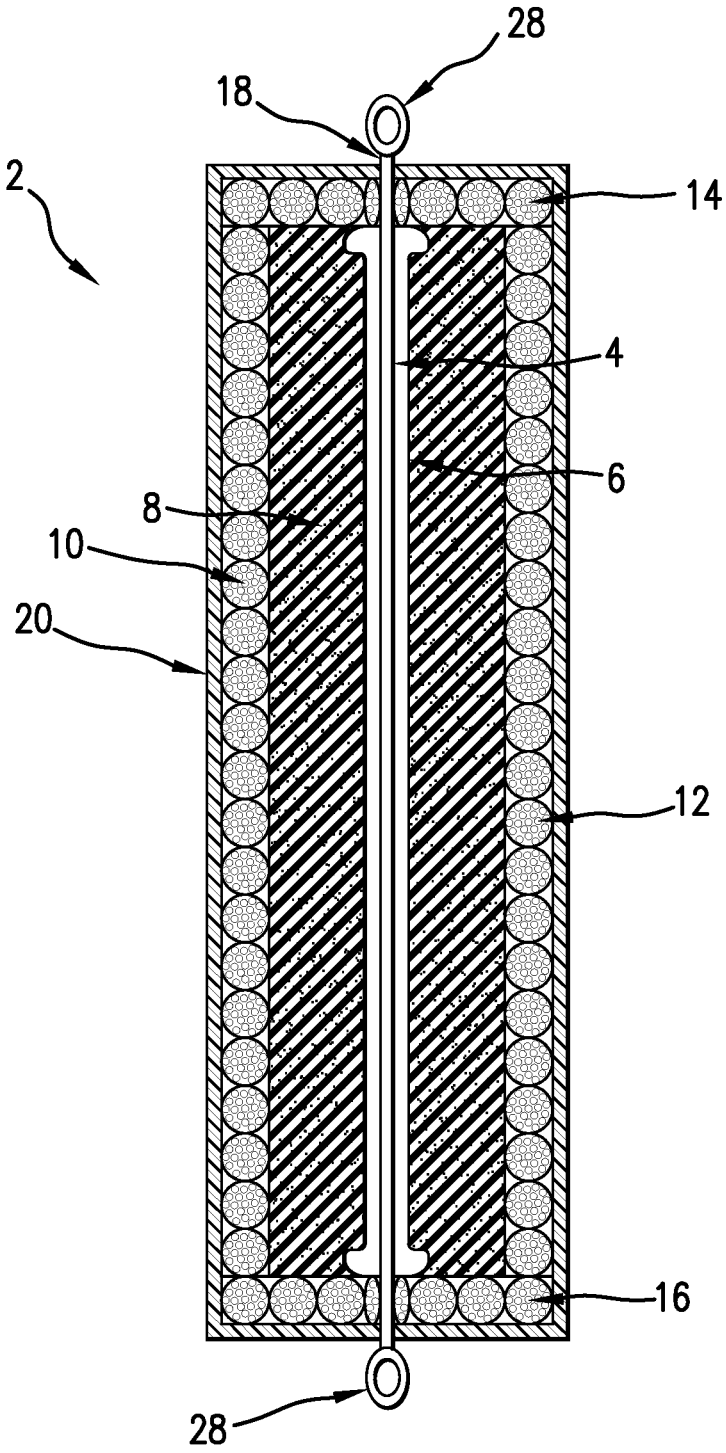
FIG. 1 is a cross-sectional view of the bag of the present invention along its vertical axis.

2 bag
4 support cable
6 support core
8 cushion core
10 impact core
12 impact core rib
14 top impact cover
16 bottom impact cover
18 support cable port
20 outer cover
22 impact cover rib
24 flange
26 seam
28 support cable

DETAILED DESCRIPTION OF THE INVENTION

The bag 2 of the present invention may be understood by reference to the figures. FIG. 1 is a cross-sectional view of the bag 2 of the present invention along its vertical axis. In a preferred embodiment, the bag 2 of the present invention is comprised of an inner support core 6 that is surrounded by a cushion core 8. The cushion core 8 is surrounded by an impact core 10. The impact core 10 is surrounded by an outer cover 20. The outer cover 20 encases the entire bag 2 of the present invention.

The bag 2 of the present invention may be of any suitable shape desired by a user for his training purposes, such as a cylindrical, heavy training bag shape, a mushroom, uppercut bag shape, or a tear drop, punching bag shape. The overall dimensions of the bag 2 of the present invention are from about 12 inches to about 42 inches in diameter and from about 12 inches to about 96 inches in length. The weight of the bag 2 of the present invention is from about 20 pounds to about 600 pounds.

The purpose of the support core 6 is to support and provide weight to the bag 2 of the present invention and to prevent deformation of the bag 2 of the present invention. In prior art bags, through the effect of gravity the weighted filler material sinks to the bottom of the bag and accordingly distends the lower portion of the prior art bag.

The support core 6 may be constructed of any suitable material, but preferably a strong and lightweight material, that enables a reasonable weight to be maintained for the bag 2 of the present invention. A preferred material for the support core 6 is PVC pipe. The support core 6 may be of a diameter from about 3 inches to about 10 inches and a length from about 16 inches to about 96 inches. The support core 6 may be filled with sand or other suitable material to provide weight and mass to the bag 2 of the present invention, which anchors the bag 2 and prevents it from flying away from a user when the user impacts the bag 2 with a kick or punch or other impact or striking motion.

The support core 6 may have a support cable 28 running through it. The support cable 28 may be any suitable material having sufficient strength and durability to support the weight of the bag 2 of the present invention, such as nylon rope, hemp rope, steel cable, chain and the like.

Alternatively, the bag 2 of the present invention may not have a support core 6, but rather only a cushion core 8 and an impact core 10. In this embodiment of the bag 2 of the present invention, the cushion core 8 serves a dual purpose to provide fill, support, mass and weight to the bag 2 of the present invention, as well as to absorb striking forces applied to and transmitted from the impact core 10.

For the purpose of mounting the bag 2 of the present invention, a support cable 28 runs through the support core 6 and exits the support cable port 18 of the bag 2 of the present invention. The support cable 28 may exit either the top support cable port 18 only, or both the top support cable port 18 and the bottom support cable port 18 of the bag to the present invention. To suspend the bag 2 of the present invention for use, a top end of the support cable 28 may be affixed to a suitable mount on a ceiling or other support apparatus. If a user of the bag 2 of the present invention desires greater support and fixed stability of the bag 2 of the present invention, the user may attach a bottom end of the support cable 28 to a floor or other support apparatus.

Alternatively, the support core 6 may not have a support cable 28 running through it. Instead, the bag 2 of the present invention may be suspended and supported in any other suitable manner. A preferred alternative embodiment is to use straps to suspend the bag 2 of the present invention; wherein from about two (2) to about 10 straps, but preferably six (6) straps, are equidistantly spaced and attached to the top edge of the impact core 10, or to the top impact cover 14, and thereby contained within the outer cover 20. The straps alternatively may pass through corresponding apertures in the outer cover 20. Alternatively, the straps may be attached to the outside cover 20. The straps may be of any suitable material with sufficient strength to support and suspend the bag 2 of the present invention, such as cable, chains, nylon webbing or the like.

Further alternatively, if a user of the bag 2 of the present invention desires greater support and fixed stability of the bag 2 of the present invention, the user may affix an at least one (1) cross support strap attached to the bottom of the outer cover 20, and in turn attach the bottom cross support strap to a floor or other support apparatus.

Figure 2:
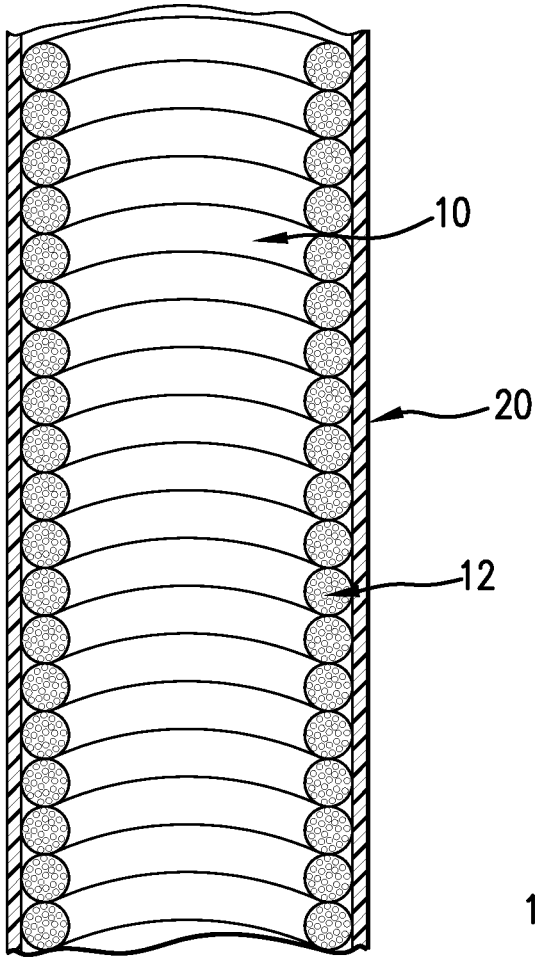
FIG. 2 is a cross-sectional view of an impact core of the bag of the present invention along its vertical axis.

FIG. 2 is a cross-sectional view of an impact layer of the bag 2 of the present invention along its vertical axis. The cross-sectional view of the impact core 10 shows that the impact core 10 is comprised of at least a rib, but preferably, a plurality of impact core ribs 12. As defined herein, a rib is a chamber capable of receiving a filler material. When each impact core rib 12 is filled with material, a rib preferably is from about 0.5 inches to about 8 inches in diameter. The impact core 10 is comprised of at least a rib, but preferably, from about 2 impact core ribs 12 (for a small size bag 2) to about 192 impact core ribs 12 (for a large size bag 2).

Each impact core rib 12 is filled with an impact-resistance material or substance, such as, polystyrene beads, gel, foam, shredded cloth, any combination thereof, or any other suitable material or substance that provides a desired impact resistance for a user. Preferably, the impact ribs 12 or, with reference to FIG. 3, impact cover ribs 22, and are filled with polystyrene beads or gel.

The diameter of the polystyrene beads determines the amount of resistance the beads will afford. Small diameter beads afford greater resistance and large diameter beads afford less resistance. Resistance may be based upon beads of a uniform diameter, or upon beads of differing diameters.

Preferably, the polystyrene beads are from about 0.018 centimeters to about 5 centimeters.

The chemical composition of the beads also may vary so that a bead may provide a desired feel or resistance to a user, and may range from a hard bead to a soft bead, such as a gel bead. Other bead variables to provide a desired feel or resistance to a user are the number of beads contained with the volume of the impact core 10, a combination of varying sizes of beads, a combination of varying chemical composition types of beads, a combination of varying layers of beads within the impact core 10, for example, soft beads in the top half of the impact core 10 and hard beads in the bottom half of the impact core 10, or any other possible variation which provides a user with a desired feel or resistance of the bag 2.

Likewise, the gel used to fill the impact ribs 12 or impact cover ribs 22 determines the amount of resistance the gel will afford. A suitable gel material to fill the impact ribs 12 is a thermoplastic elastomer, such as that available from GLS Corporation and sold under the product name VERSAFLEX® CL200X. Another suitable gel material to fill the impact ribs 12 is a utility grade resin formed into pellets or beads, such as that available from The Dow Chemical Company and sold under the product name POE 8999 Utility Grade Resin.

The impact core 10 may be constructed initially as a substantially two-dimensional, rectangular shape. Then the rectangular shape is configured to permit it to be joined along a seam 26 to form a three-dimensional, tubular-shaped impact core 10. The seam can be fashioned by joining the opposite ends of the impact core 10 through any suitable means, such as sewing, gluing, hook and loop tape, a zipper, heat welding, or the like. Alternatively, the impact core 10 may also be constructed as a uniform, seamless tube, or as a uniform, seamless cylinder.

In an embodiment of the bag 2 of the present invention, the impact core 10 can be fashioned of two pieces of material having the same or similar shape, wherein the shape is suitable to the type of heavy training bag desired by a user, such as a cylindrical, heavy training bag shape, a mushroom, uppercut bag shape, or a tear drop, punching bag shape. The two, suitably shaped pieces of material (to illustrate, such as a rectangular shape for a cylindrical, heavy training bag), are laid one on top of the other and the impact core ribs 12 are created by fashioning chambers within the impact core 10 by interfacing and attaching the two pieces of material together and creating rib chambers therein through any suitable means, such as sewing, gluing, heat welding, or the like. The impact core 10 may be made of any suitable material that is durable, yet will not inflict injury upon a user when the user strikes the bag 2 of the present invention, such as neoprene, plastic, nylon, leather, vinyl, canvas, felt and the like.

Figure 3:
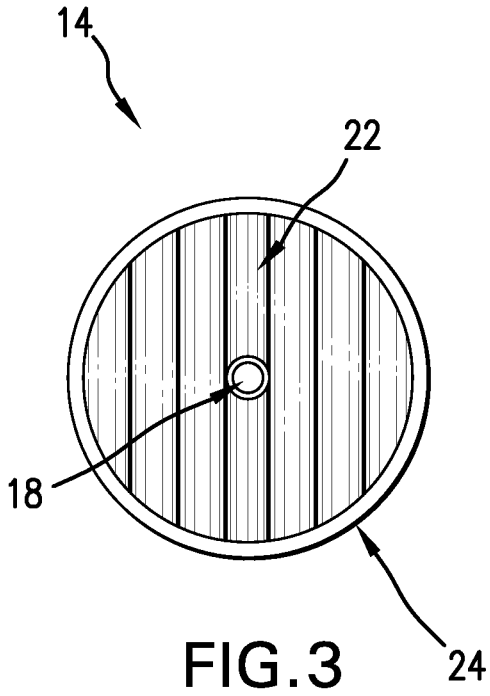
FIG. 3 is a top plan view of an impact covering of the bag of the present invention; wherein the top impact covering and the bottom impact covering are substantially the same and interchangeable.

FIG. 3 is a top plan view of an impact cover 14, 16 of the bag 2 of the present invention; wherein the top impact cover 14 and the bottom impact cover 16 are substantially the same and may be interchangeable. The impact cover 14, 16 enables a user also to use the top and bottom of the bag 2 as strike zones with the attendant benefits of the impact core 10. For purposes of illustration, FIG. 3 shows the top impact cover 14 only. The top impact cover 14 may be circular-shaped and comprised of at least one impact cover rib 22. There may be an opening in the top impact cover 14, namely, support cable port 18 for a bag 2 of the present invention with a support cable 4 embodiment. The top impact cover 14 also may be comprised of a flange 24 which permits the top impact cover 14 to be joined to the impact core 10 of the bag 2 of the present invention.

Conversely, the bottom impact cover 16 may be circular-shaped and comprised of a plurality of impact cover ribs 22. There may be an opening in the bottom impact cover 16, namely, support cable port 18 for a bag 2 of the present invention with a support cable 4 embodiment. The bottom impact cover 16 also may be comprised of a flange 24 which permits the bottom impact cover 16 to be joined to the impact core 10 of the bag 2 of the present invention.

Each impact cover rib 22 is preferably from about 0.5 inches to about 8 inches in diameter. The top impact cover 14 and the bottom impact cover 16 are each comprised of about 1 to about 84 impact cover ribs 22.

Figure 4:
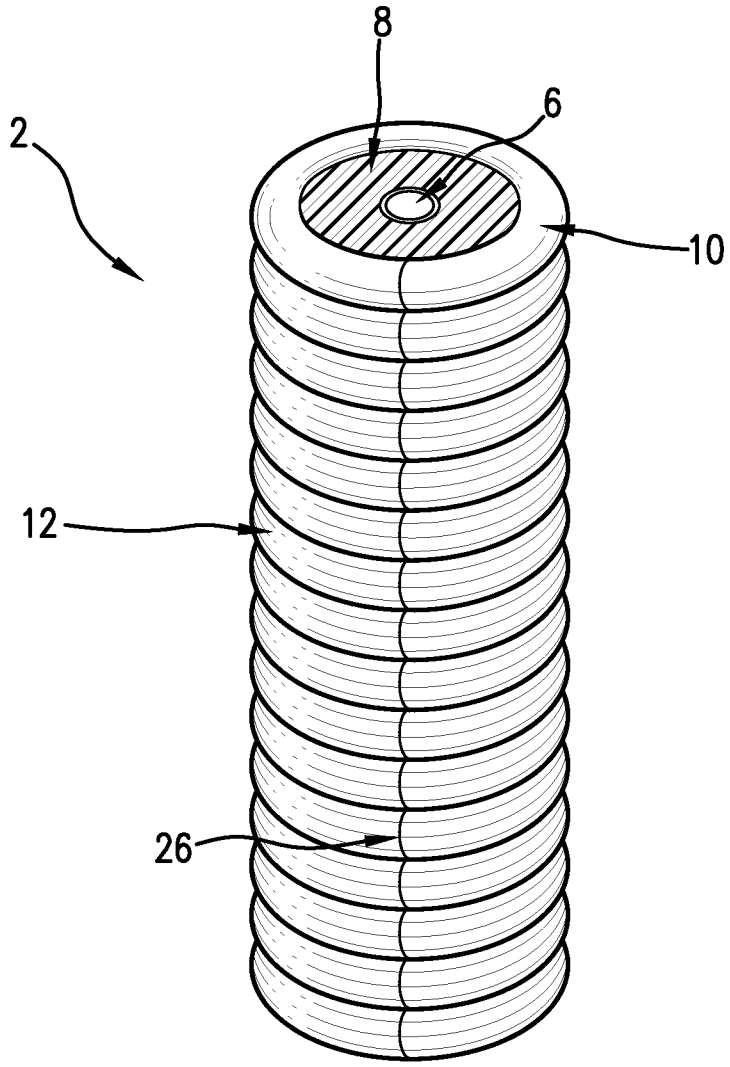
FIG. 4 is a perspective view of a support core, cushion core and impact core of the bag of the present invention.

FIG. 4 is a perspective view of a support core 6, cushion core 8 and impact core 10 of the bag 2 of the present invention. The support core 6 is surrounded by the cushion core 8, which in turn is surrounded by the impact core 10.

The cushion core 8 is a unitary core comprised of any suitable cushioning material or substance, such as foam, cloth, gel, and the like. Preferably, the cushion core 8 is comprised of foam, which may be either a unitary block of foam, or pieces of foam. The cushion core 8 may have a through channel to accommodate a support core 6; wherein the dimensions of the Page of through channel are from about 2" to about 6" in diameter. The cushion core 8 may have an outside diameter from about 12" to about 24".

With reference to FIG. 4, the plurality of impact core ribs 12 of the impact core 10 of the bag 2 of the present invention lend a lifelike feel of the bag 2 of the present invention to a user. The impact core 10 mimics a rib cage of a torso of a human. As a result, when a user strikes the bag 2 of the present invention, the impact and the resistance of the strike feel to the user like striking a human body. Other benefits of the impact core 10 and bag 2 of the present invention are that there is less recoil of the bag 2 after a user strikes the bag 2, a user's joint damage resulting from striking the bag 2 is decreased, and the entire bag 2 is a sweet spot for striking by a user and not just a particular zone or zones of a bag as is common with prior art bags.

Figure 5:
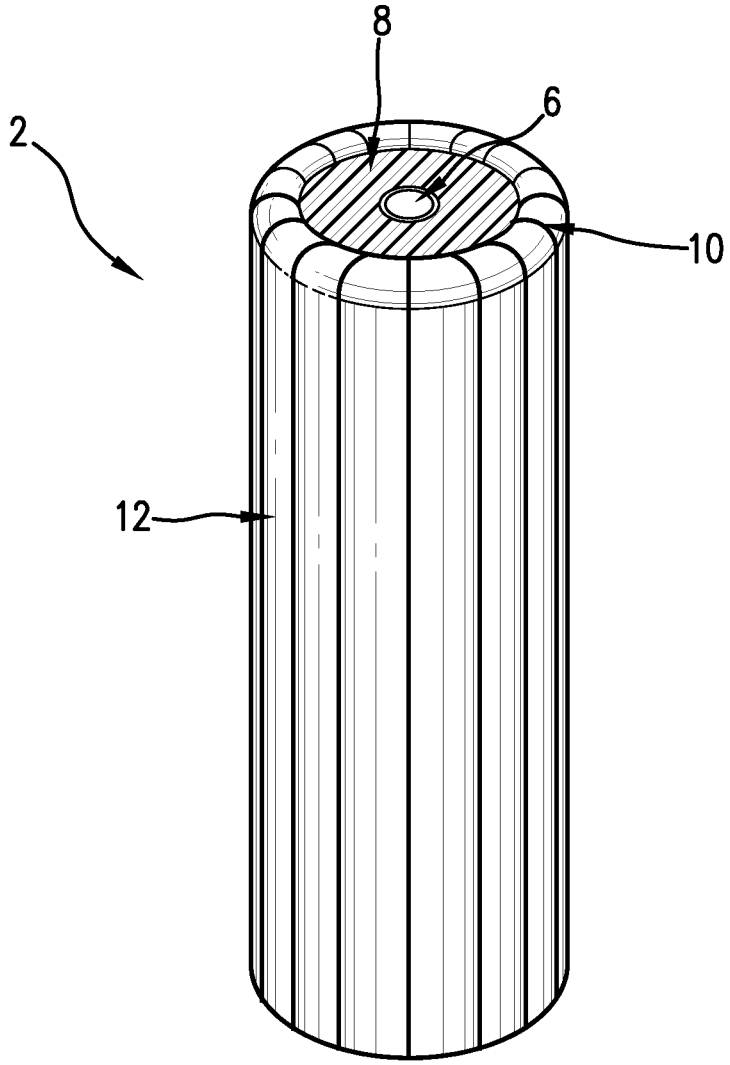
FIG. 5 is a perspective view of a support core, cushion core and impact core of the bag of the present invention depicting vertically oriented ribs.
Figure 6:
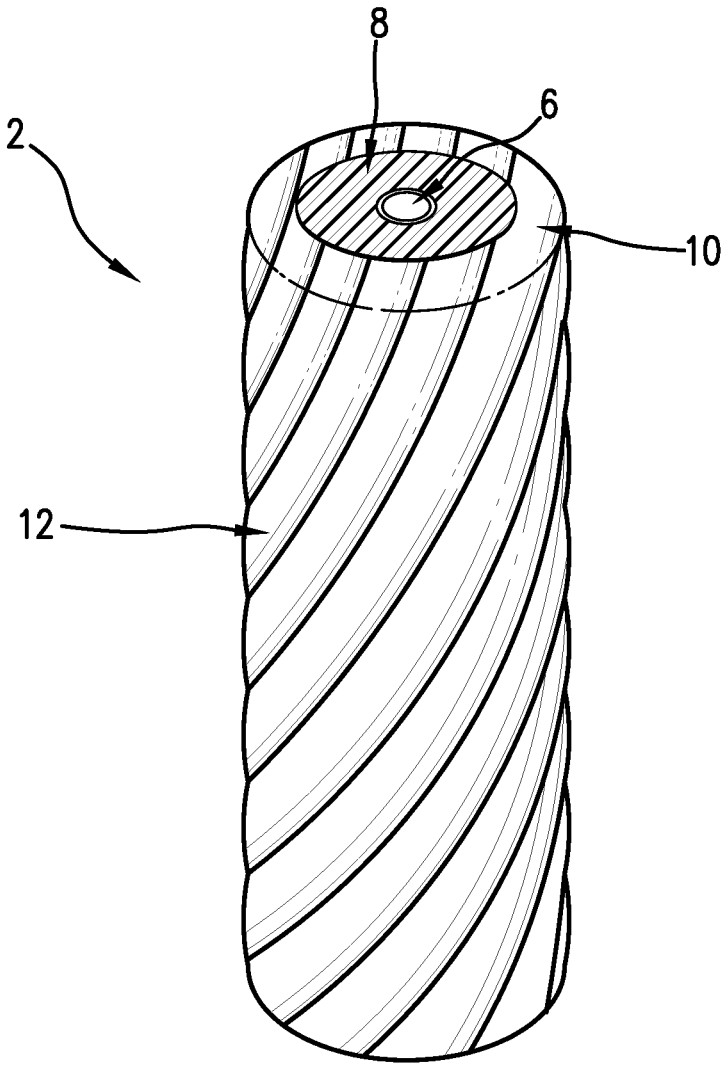
FIG. 6 is a perspective view of a support core, cushion core and impact core of the bag of the present invention depicting diagonally oriented ribs.
Figure 7:
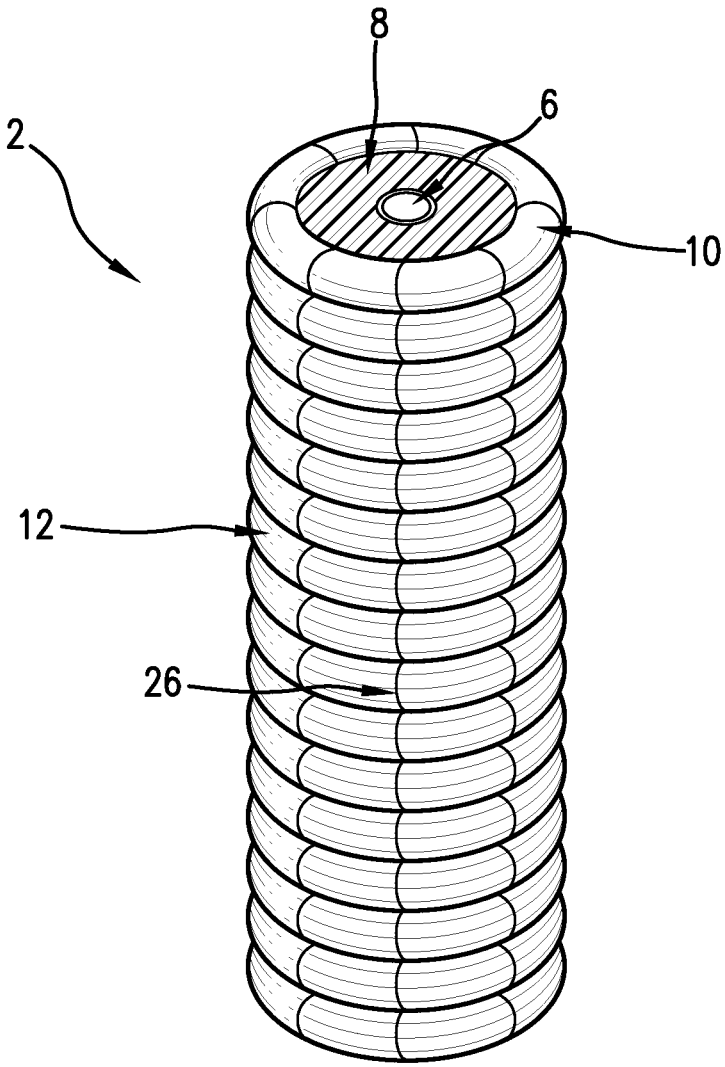
FIG. 7 is a perspective view of a support core, cushion core and impact core of the bag of the present invention depicting cells of the ribs.

With reference to FIG. 5, FIG. 6 and FIG. 7, the impact core 10 may have the impact core ribs 12 either horizontally, vertically or diagonally oriented with regard to the longitudinal axis of the bag 2 of the present invention. Preferably, the impact core ribs 12 are horizontally oriented with regard to the longitudinal axis of the bag 2 of the present invention, so to better approximate the feel of a human body when struck by a user.

With reference to FIG. 5, if the impact core ribs 12 are vertically oriented, then the ribs extend from a bottom edge of the impact core 10 to a top edge of the impact core 10.

With reference to FIG. 6, if the impact core ribs 12 are diagonally oriented, then the angle of orientation may be from about greater than 0° to about Page of less than 90° with respect to the longitudinal axis of the bag 2. Preferably, the impact core ribs 12 have an angle of orientation of about 45° with respect to the longitudinal axis as shown in FIG. 6. Also as shown in FIG. 6, preferably, the diagonally oriented impact core ribs 12 do not intersect with each other, rather the impact core ribs 12 preferably extend in continuous fashion from a bottom edge of the impact core 10 to a top edge of the impact core 10, and as a result, the impact core ribs 12 appear curvaceous as they twist, curve or wrap about the longitudinal axis of the bag 2.

With reference to FIG. 7, in an alternative embodiment, an impact core rib 12, whether horizontally, vertically or diagonally oriented, may be comprised of more than 1 cell or compartment in quilt-like fashion. As shown in FIG. 7, the impact core ribs 12 are horizontally oriented with respect to the longitudinal axis of the bag 2 and have cells therein. Such cells may or may not be contiguous, depending upon the desired interstices between cells. If the impact core ribs 12 are comprised of more than 1 cell, then the cells also may be of non-uniform or uniform size, at the preference of the user. The cells also may be configured to align in a stacked arrangement upon each other as shown in FIG. 7 (wherein each cell is uniformly aligned with the cells above and below it), or alternatively may be configured to align in a staggered arrangement with respect to each other (wherein each cell is non-uniformly aligned with the cells above and below it).

With reference to FIG. 1, the impact core 10 of the bag 2 of the present invention is surrounded by an outer cover 20. The outer cover 20 encases the entire bag 2 of the present invention. The outer cover 20 may be made of any suitable material that is durable, yet will not inflict injury upon a user when the user strikes the bag 2 of the present invention, such as leather, vinyl, canvas, felt and the like. Alternatively, the bag 2 of the present invention need not have an outer cover 20.

Although the present invention has been described with reference to specific embodiments, it is understood that modifications and variations of the present invention are possible without departing from the scope of the invention, which is defined by the claims set forth below.

The invention claimed is:

1. A heavy training bag comprising:

a. A cushion core contained within, and b. An impact core comprising a plurality of ribs, wherein the ribs of the impact core are filled with an energy-absorbing material selected from the group consisting of polystyrene beads and gel;

further wherein the ribs of the impact core maintain a uniform distribution of the energy-absorbing material and prevent the energy-absorbing material from settling.

2. The heavy training bag of claim 1; further comprising a support core contained within the cushion core.

3. The heavy training bag of claim 1; further wherein the impact core is contained within an outer cover.

4. The heavy training bag of claim 1; further wherein each of the ribs of the impact core is comprised of at least a cell.

5. The heavy training bag of claim 1; further wherein the plurality of ribs of the impact core are horizontally oriented with regard to a longitudinal axis of the bag.

6. The heavy training bag of claim 1; further wherein the plurality of ribs of the impact core are vertically oriented with regard to a longitudinal axis of the bag.

7. The heavy training bag of claim 1; further wherein the plurality of ribs of the impact core are diagonally oriented with regard to a longitudinal axis of the bag.

8. A heavy training bag comprising:

a. A support core contained within, b. A cushion core contained within, and c. An impact core comprising a plurality of ribs, wherein the ribs of the impact core are filled with an energy-absorbing material selected from the group consisting of polystyrene beads and gel;

further wherein the ribs of the impact core maintain a uniform distribution of the energy-absorbing material and prevent the energy-absorbing material from settling.

9. The heavy training bag of claim 8; further wherein the impact core is contained within an outer cover.

10. A heavy training bag comprising:

a. A support core contained within, b. A cushion core contained within, c. An impact core comprising a plurality of ribs, wherein the ribs of the impact core are filled with an energy-absorbing material selected from the group consisting of polystyrene beads and gel, and the impact core is contained within; and d. An outer cover;

further wherein the ribs of the impact core maintain a uniform distribution of the energy-absorbing material and prevent the energy-absorbing material from settling.

* * * * *